US006074492A

United States Patent [19]

Panchanathan

[11] Patent Number: 6,074,492

[45] Date of Patent: Jun. 13, 2000

[54] BONDED ND-FE-B MAGNETS WITHOUT VOLUMETRIC EXPANSION DEFECTS

[75] Inventor: Viswanathan Panchanathan, Anderson, Ind.

[73] Assignee: Magnequench International, Inc., Anderson, Ind.

[21] Appl. No.: 09/000,790

[22] Filed: Dec. 30, 1997

[51] Int. Cl.[7] ..... H01F 1/057

[52] U.S. Cl. ..... 148/101; 148/302

[58] Field of Search ..... 148/302, 101, 148/102

[56] References Cited

U.S. PATENT DOCUMENTS 4,747,924 5/1988 Itoah et al. ..... 204/225

*Primary Examiner*—John Sheehan
*Attorney, Agent, or Firm*—Pennie & Edmonds LLP

[57] ABSTRACT

A rare earth-iron-boron magnetic composition containing a rare earth fluoride compound in a sufficient amount to reduce or eliminate the formation of rare earth hydroxide and a method of making the same. The reduction or elimination of the formation of rare earth hydroxide substantially eliminates or significantly reduces eruptions in bonded magnets caused by volumetric expansion defects.

6 Claims, 2 Drawing Sheets

BONDED ND-FE-B MAGNETS WITHOUT VOLUMETRIC EXPANSION DEFECTS

FIELD OF THE INVENTION

This invention relates generally to bonded magnets, and more particularly to a composition of a rare earth-ironboron magnet alloy with a rare-earth fluoride compound, and a process for substantially preventing volumetric expansion defects in rare earth-iron-boron magnets.

BACKGROUND OF THE INVENTION

In a bonded neodymium-iron-boron (NdFeB) magnet, neodymium oxide ($Nd_2O_3$) is present. $Nd_2O_3$ reacts with water ($H_2O$) to form neodymium hydroxide ($Nd(OH)_3$) according to:

$$Nd_2O_3+3H_2O \rightarrow 2Nd(OH)_3$$

The density of $Nd_2O_3$ is 7.28 g/cc, whereas the density of $Nd(OH)_3$ is 5.60 g/cc. This decrease in density resulting from the formation of $Nd(OH)_3$ causes a volumetric expansion, which may cause an eruption in the magnet. A motor made of such magnets and having a sufficiently small air gap between moving components can be stalled by such eruption. A need exists to prevent formation of $Nd(OH)_3$ in bonded NdFeB magnets, which are used in a wide spectrum of industries including computers, automobiles, consumer electronics, and household goods.

SUMMARY OF THE INVENTION

The main object of this invention is to provide a composition for a bonded rare earth-iron-boron magnet which substantially prevents the formation of volumetric expansion defects, and a process for making bonded rare earth-ironboron magnets without such defects. More particularly, an object of this invention is to provide a composition which includes a rare earth fluoride compound. Preferably, the rare earth fluoride compound is $NdF_3$.

These objects are attained by including a rare earth fluoride compound in an amount sufficient to substantially prevent the formation of rare earth hydroxide, such as $Nd(OH)_3$, within the magnets during processing. A significant feature of the invention is that the rare earth fluoride compound, such as $NdF_3$, reacts with rare earth oxide, such as $Nd_2O_3$, present in the alloy, thus leaving little or no rare earth oxide available to react with water to form $Nd(OH)_3$. Thus this invention substantially eliminates or significantly reduces eruptions in bonded magnets caused by volumetric expansion defects.

BRIEF DESCRIPTION OF THE DRAWINGS

These and other objects, features and advantages of the invention will be more apparent from the following detailed description in conjunction with the appended drawings in which.

DESCRIPTION OF THE INVENTION

Volumetric expansion defects in bonded rare earth-iron-boron magnets, such as NdFeB magnets, may be substantially eliminated or significantly reduced by a composition of rare earth-iron-boron alloy with a rare earth fluoride compound included in an amount sufficient to prevent the formation of rare earth hydroxide, such as neodymium hydroxide. The process of making a bonded rare earth-iron-boron magnet without volumetric expansion defects requires the addition of a rare earth fluoride compound, such as $NdF_3$, to the magnet alloy in either the alloy making or melt spinning stage. In a neodymium-iron-boron magnet, addition of $NdF_3$ leads to the reaction:

$$Nd_2O_3+NdF_3 \rightarrow 3NdOF$$

Neodymium oxyfluoride (NdOF) is inert and will not react with water. Because little or no neodymium oxide ($Nd_2O_3$) is available for reaction with water to form neodymium hydroxide ($Nd(OH)_3$), volumetric expansion defects occur are substantially eliminated or significantly reduced.

The reaction between $Nd_2O_3$ and $NdF_3$ occurs spontaneously at 524° C. During alloy making and melt spinning, the operating temperatures are 1450° C.; at this temperature, NdOF is-easily formed. Any excess, unreacted $NdF_3$ will be in the liquid state since its melting point is 1377° C. $NdF_3$ is inert and will not react with water.

In the examples described below, $NdF_3$ was added to the molten alloy, but it may also be added during such processes, such as melt spinning or gas atomization. The reaction described above will occur at this stage, leaving little or no free $Nd_2O_3$ available to form $Nd(OH)_3$.

The following examples are intended to be illustrative of the present invention and should not be construed, in any way, to be a limitation thereof.

EXAMPLES

Example 1

Bonded NdFeB magnets were made by a melt spinning process. The nominal composition of the NdFeB alloy was: 27.5 wt % of rare earth, 5 wt % of Co, 0.9 wt % of boron, and balanced with Fe. This alloy was melt-spun at 22 m/sec, crushed into power, and annealed at 640° C. for 4 minutes. Bonded magnets were made by mixing the power with 2% epoxy and 0.1% zinc stearate as a lubricant. Green compacts were made at a pressure of 40 tons per square inch followed by curing at 170° C. for 30 minutes. The final magnet dimensions were: 29 mm O.D., 24 mm I.D., 8 mm height.

These magnets were exposed at 85° C. and 85% relative humidity (RH) for 15 hours. They were then cooled to room temperature and inspected under an optical microscope at 10×magnification. White spots, found in erupted areas in a few magnets, were determined to be $Nd(OH)_3$ which results from the reaction of $H_2O$ with $Nd_2O_3$. Because of the density difference between $Nd_2O_3$ and $Nd(OH)_3$, volumetric expansion occurs which causes eruption in the magnets.

Example 2

Figure 1:
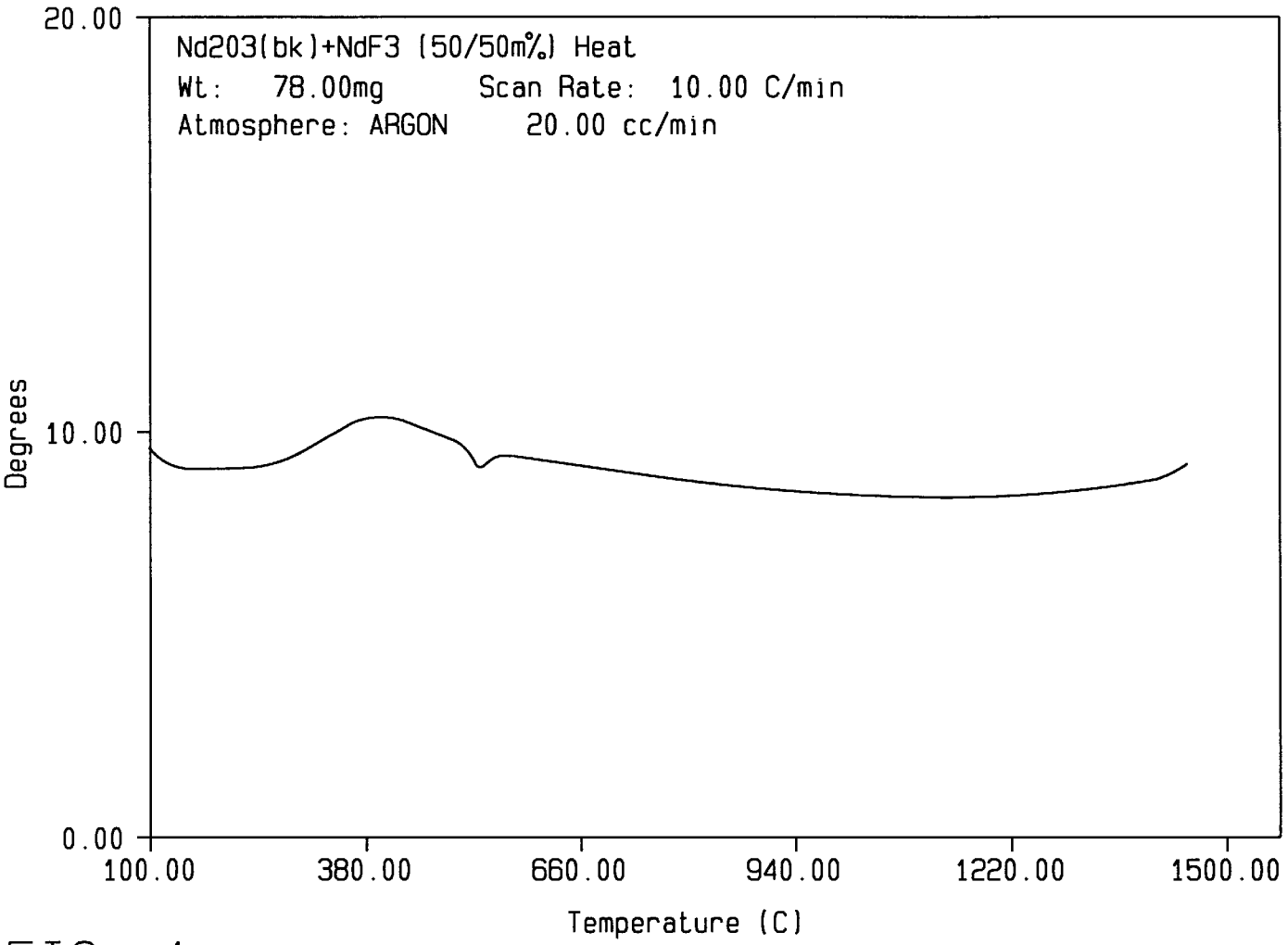
FIG. 1 is the differential thermal analysis ("DTA") curve of an equimolar $Nd_2O_3$—$NdF_3$ mixture on heating.
Figure 2:
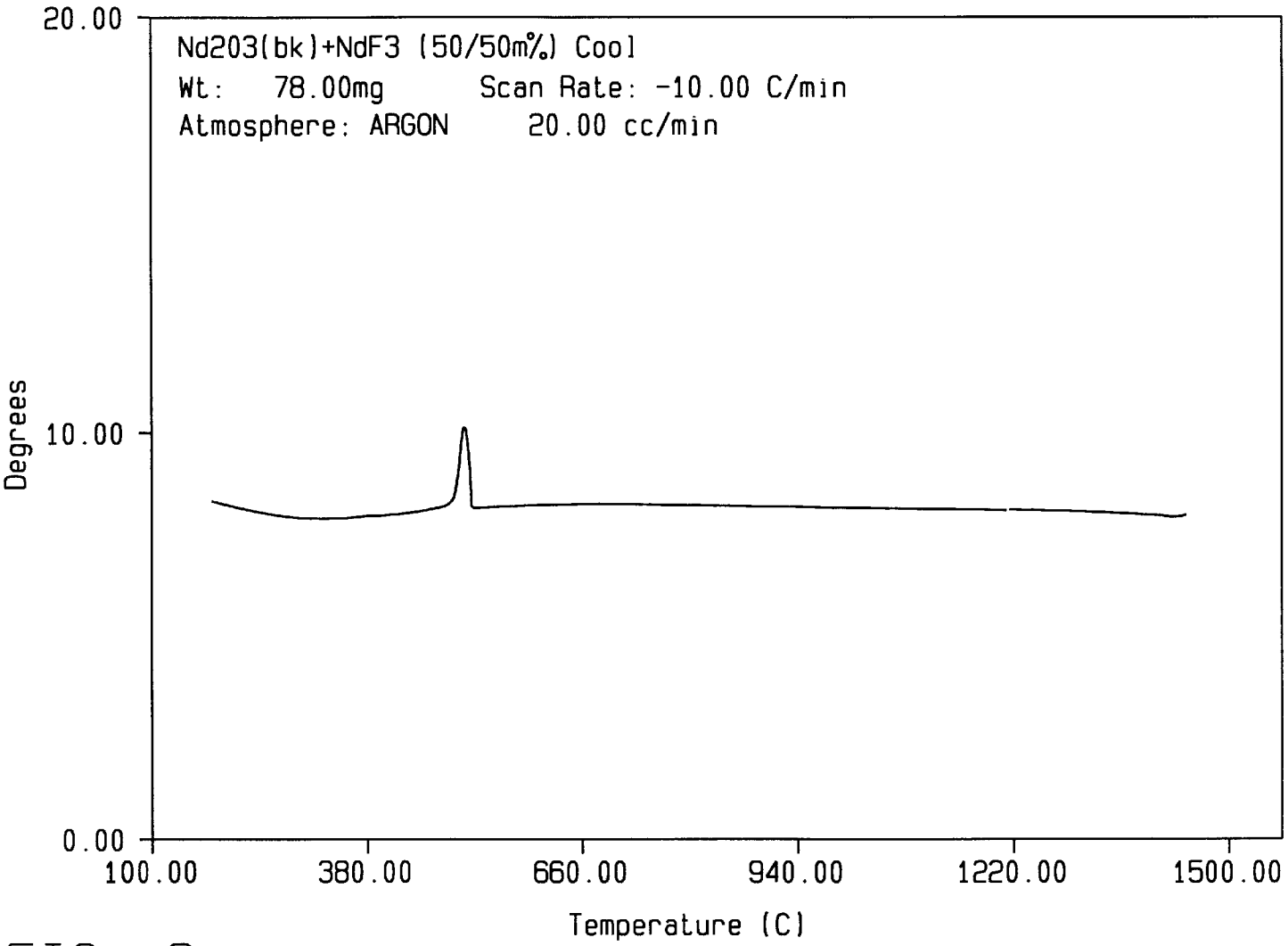
FIG. 2 is the DTA curve of an equimolar $Nd_2O_3$—$NdF_3$ mixture on cooling.

An eguimolar mixture of $Nd_2O_3$ and $NdF_3$ was heated to 1500° C. The mixture reacted to form NdOF. The absence of a peak at 1377° C. due to melting of $NdF_3$ in the differential thermal analysis ("DTA") curve shown in FIG. 1 indicates that there is no $NdF_3$. The transition peak of NdOF is apparent at 524° C., as shown in FIG. 2.

Example 3

Five pounds of alloy, of nominal composition as given in Example 1 along with 0.5 wt % $Nd_2O_3$, was made in an induction furnace, then melt-spun and processed into magnets. The reason for the addition of the $Nd_2O_3$ was to more clearly show the eruption effect due to the reaction with $H_2O$ to form $Nd(OH)_3$. The magnets were exposed at 85° C. and 85% relative humidity for 15 hours. Upon examination with an optical microscope at 10× magnification, 8 severe eruptions were found out of 120 magnets.

Example 4

Five pounds of alloy was made in an induction furnace. Both 0.5 wt % $Nd_2O_3$ and 0.7 wt % $NdF_3$ were added to the nominal composition as given in Example 1. Magnets were made as described in Example 3 and examined after exposure at 85° C. and 85% relative humidity for 15 hours. No severe eruptions were found in 120 magnets, indicating that the addition of $NdF_3$ prevents the eruptions from occurring.

In the composition of the present invention, other elements may also be present in minor amounts of up to about two weight percent, either alone or in combination. These elements include, but not limited to, tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

The present invention is not to be limited in scope by the specific embodiments described which are intended as single illustrations of individual aspects of the invention, and functionally equivalent methods and components are within the scope of the invention. Indeed, various modifications of the invention, in addition to those shown and described herein, will become apparent to those skilled in the art from the foregoing description and accompanying drawings. Such modifications are intended to fall within the scope of the appended claims.

What is claimed is:

1. A magnetic composition comprising:

a magnetic alloy comprising one or more rare earth metals, iron and boron;

a rare earth fluoride compound included with said alloy in an amount sufficient to reduce or substantially eliminate formation of rare earth hydroxide.

2. The composition of claim 1 wherein the rare earth metals include neodymium, and the rare earth fluoride compound is neodymium fluoride.

3. The composition of claim 1 wherein the magnetic alloy further comprises cobalt.

4. A process for making a rare-earth-iron-boron material, comprising the steps of adding a rare earth fluoride compound to a magnetic alloy in an amount sufficient to substantially prevent the formation of rare earth hydroxide within the magnetic alloy, the magnetic alloy comprising one or more rare earth metals, iron and boron.

5. The process of claim 4 wherein the rare earth metals include neodymium, and the rare earth fluoride is neodymium fluoride.

6. The process of claim 4 wherein the magnetic alloy further comprises cobalt.

* * * * *